United States Patent [19]

Crevoisier

[11] 3,973,360

[45] Aug. 10, 1976

[54] CAM CONTROLLED GRINDING MACHINE

[76] Inventor: René Crevoisier, 2714 Les Geneva, Switzerland

[22] Filed: Dec. 10, 1974

[21] Appl. No.: 531,364

[30] Foreign Application Priority Data

Dec. 10, 1973 Switzerland ..... 17263/73
Jan. 28, 1974 Switzerland ..... 15792/74

[52] U.S. Cl. ..... 51/101 R; 51/127; 51/145 R

[51] Int. Cl.[2] ..... B24B 17/08; B24B 21/02

[58] Field of Search ..... 51/135 R, 145 R, 101 R, 51/127, 144

[56] References Cited

UNITED STATES PATENTS 1,156,323 10/1915 Shearer ..... 51/101 R
1,840,231 1/1932 Harrison et al. ..... 51/101 R
2,406,689 8/1946 Indge ..... 51/101 R

*Primary Examiner*—Al Lawrence Smith
*Assistant Examiner*—Nicholas P. Godici
*Attorney, Agent, or Firm*—Young & Thompson

[57] ABSTRACT

A machine is provided for grinding small parts in which a rigid frame carries a rotatable flat grinding surface, a cam rest with a flat surface parallel to the fat grinding surface and a mobile carriage movable in a direction perpendicular to the flat grinding surface, a rotary guide cam and a workpiece are carried by said carriage and are rotatable in synchronism, a first control device for movement of said carriage and a second control device for regulating the pressure with which the workpiece is applied to the grinding surface are mounted on said frame and the first and second control devices are embodied in a single unit.

9 Claims, 11 Drawing Figures

CAM CONTROLLED GRINDING MACHINE

Figure 1:
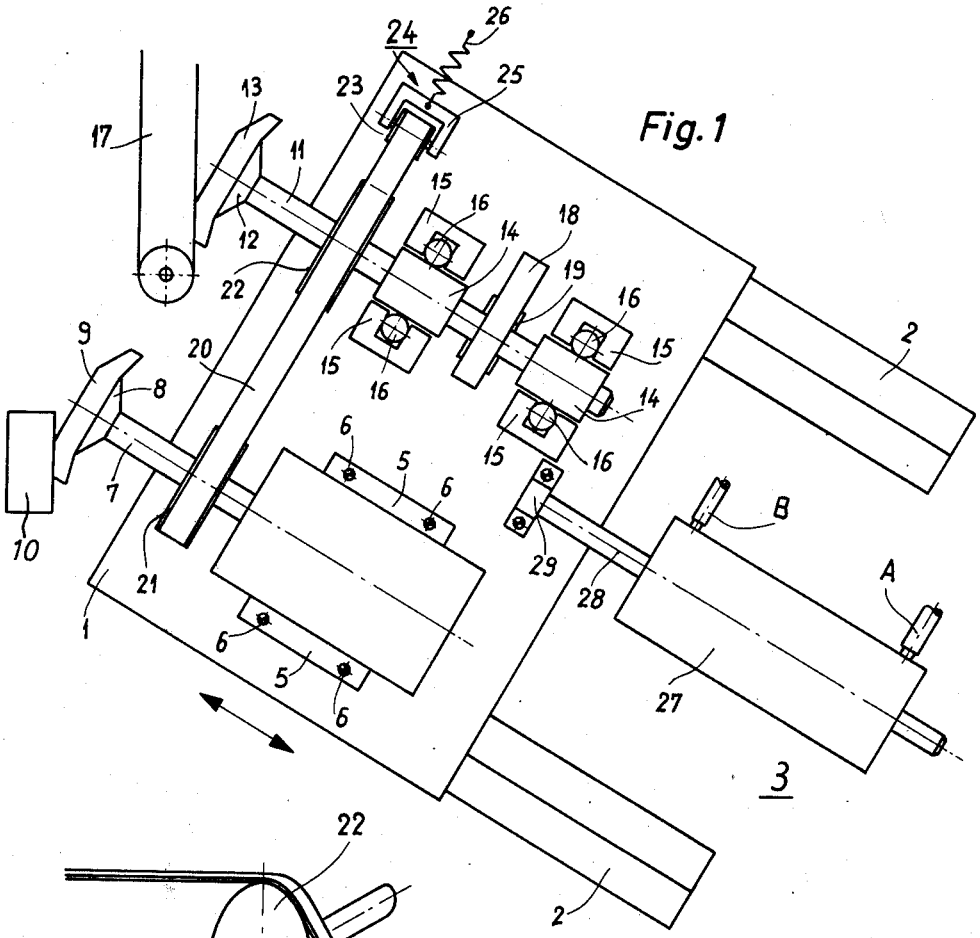

The present invention concerns a grinding process and a machine for operating the process destined for the precision grinding of small mechanical parts.

At the present time, due to the lack of appropriate machines a number of precision mechanical parts and particularly parts of very small dimension are ground manually, which not only limits the quality of their finish but even more considerably increases their cost price.

Semi-automatic grinding machines are known on which the pieces to be ground are fixed on a swiveling drum alternately adapted to regularly bring the said pieces in contact with a grinding surface. These machines are not very precise and make it possible to grind only a very small range of different surfaces.

The present invention proposes to solve these inconveniences by providing a grinding process in which at least one part to be ground is brought into an operating position in which it is driven in uniform rotation and subjected to a traversing movement along an axis parallel to a grinding surface by means of a control device moving the part axially. When in this position, the part rests permanently against the grinding surface with a pressure predetermined control device in which the contact of the part with a grinding surface is controlled automatically by means of a guiding cam.

The present invention concerns furthermore a grinding machine comprising a rigid frame and at least one mobile table subjected to a traversing movement, a mobile carriage alongside guide rails forming part of the table, a device controlling the movement of the carriage, a stop having a flat surface serving as a rest for a rotary guidance cam and being fixed rigidly to the mobile table, a grinding surface parallel to the flat surface of the fixed stop and fitted to the frame, a driving device of the said rotary cam, coupled with a driving device for a grinding part, both being part of the mobile carriage and a pressure control device for the part to be ground against the grinding surface.

According to one form of construction, the device controlling the pressure with which the part to be ground is applied to the grinding surface, comprises at least one pneumatic or hydraulic cylinder having a mobile piston rod connected to the mobile carriage mentioned above. Independently of the pneumatic or hydraulic pressure acting on the piston rod it can be subjected to the action of a spring which has the function of maintaining constant pressure of the part to be ground against the grinding surface.

The carriage supports a motor driving a shaft at the extremity of which is fitted the rotary cam having the shape of a part to be ground such as it is after the grinding operation. A mechanical coupling, such as a notched belt, permits the simultaneous driving and at the same speed of a second shaft, the extremity of which carries the part to be ground. The mechanical coupling could be replaced by a second drive motor identical to the first one and synchronised with same.

The rotary shaft carrying the part to be ground can be fitted on a support with columns actuated by an alternative movement by means of an excentric. To insure a regular drive and a constant tension of the notched belt, the latter can pass over a fixed tension device on the mobile carriage.

According to one form of construction, the grinding surface is an abrasive endless band, turning on two cylinders of parallel axis, one of which at least is motor driven. The frame preferably made up of an assembly of rigid sections welded and bolted together, supports two or more mobile tables moving simultaneously, the movement being reciprocating vertically or horizontally. The extent of the reciprocating movement is such that the part to be ground associated with each table is machined by one of the other half of the abrasive band.

The piston forming part of the mobile carriage consists of a main piston sliding inside the cylinder and on the action of a pressurised fluid injected into one or the other of these chambers and of a secondary piston co-axial with the principal piston and which can slide co-axially in a central cylindrical opening of the principal piston.

According to another form of construction, the mobile carriage is connected to the piston by means of a piston rod, the relatively large section of which is determined so that the force exercised by the fluid on the circular surface of the piston in one of the cylinder chambers is superior to that exercised by the fluid on the annular surface of the piston in the other cylinder chamber.

According to another form of construction, the mobile carriage is controlled by two pistons of different diameter, the one with double effect, the other with single effect, contained respectively in two cylinders of parallel axes. The piston with double effect, of large diameter, controls the large movements of the mobile carriage, whereas the single effect piston of small diameter controls the smaller movements of the part to be machined near the operating position, and makes it possible to regulate the pressure with which the part is applied to the abrasive surface.

According to one form of construction of the grinding machine, the position after stop which acts as rest for the cam having the same shape as the part to be machined, can be defined with precision in order to regulate the depth of the machining passes.

Knowing that the precision grinding of a part to be machined necessitates rotations of the part in question in contact with a grinding surface, the extent of the reciprocating movement and its frequency have been determined in such a way that even if the number of rotations is small, which is generally the case, the part remains in contact with the abrasive surface during at least one complete cycle of the reciprocating movement. In this manner, the wear of the grinding surface is uniform on the complete width of the band.

For grinding conical surfaces, it is preferable to use a grinding machine in accordance with the invention in which the reciprocating movement of the table is effected vertically along the two vertical guiding columns. In this case the cam drive and work piece drive shafts form an angle with the direction in which the carriage moves, this angle being determined in such a way that the conical surface of the cam comes to rest during the rotation of that cam against the flat surface of the stop fixed on the table.

For grinding cylindrical surfaces, it is preferable to use a grinding machine in accordance with the invention in which the reciprocating movement is effected horizontally along two horizontal guide rails. In this case the abrasive band moves along a vertical axis, the table being actuated by an alternative horizontal movement along a perpendicular axis to the moving axis of the grinding surface.

In both cases the table is driven in its reciprocating movement by a motor the shafts of which carries an excentric. When this movement is made along a vertical axis, the table is coupled to the excentric in such a way that all its weight rests on it. When the movement is made along a horizontal axis, an excentric pin engages in a vertical slit of rigid part forming one piece with the table and pushes alternatively the table to one side or the other in the course of its rotation around the axis of the motor.

Figure 4:
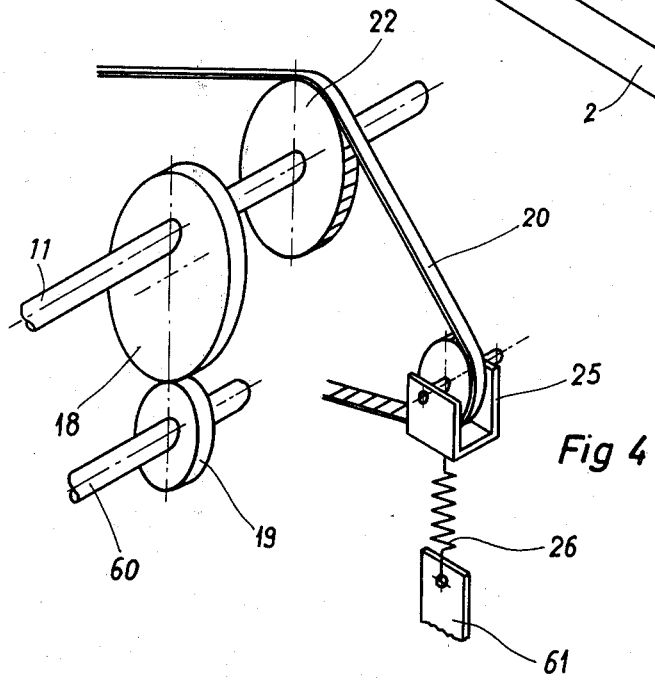
Figure 2:
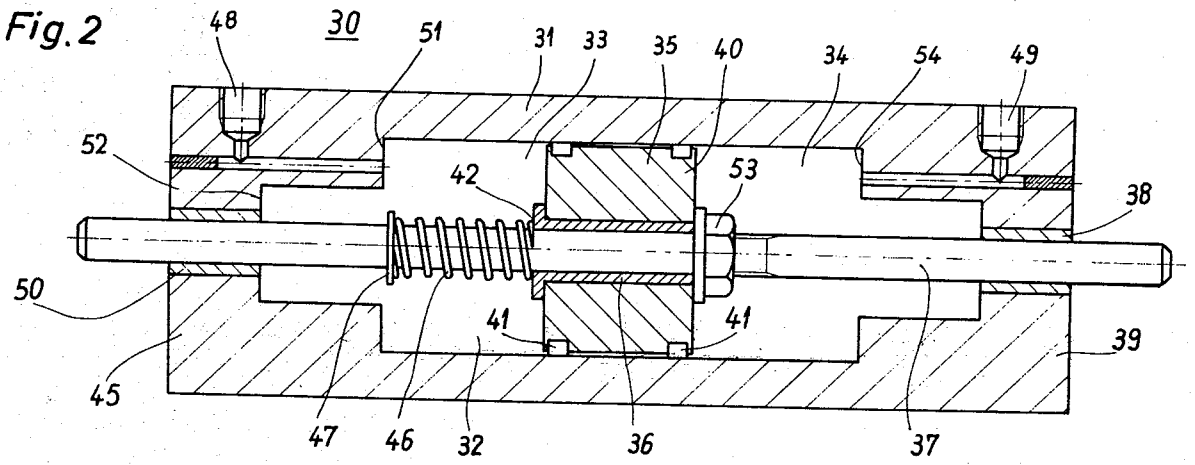
Figure 3:
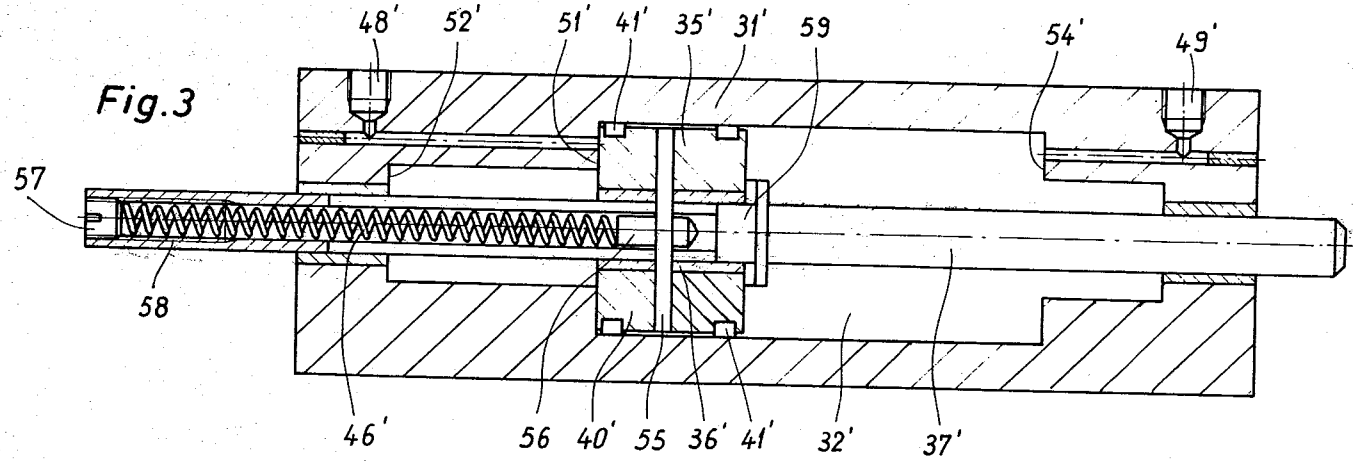
Figure 5:
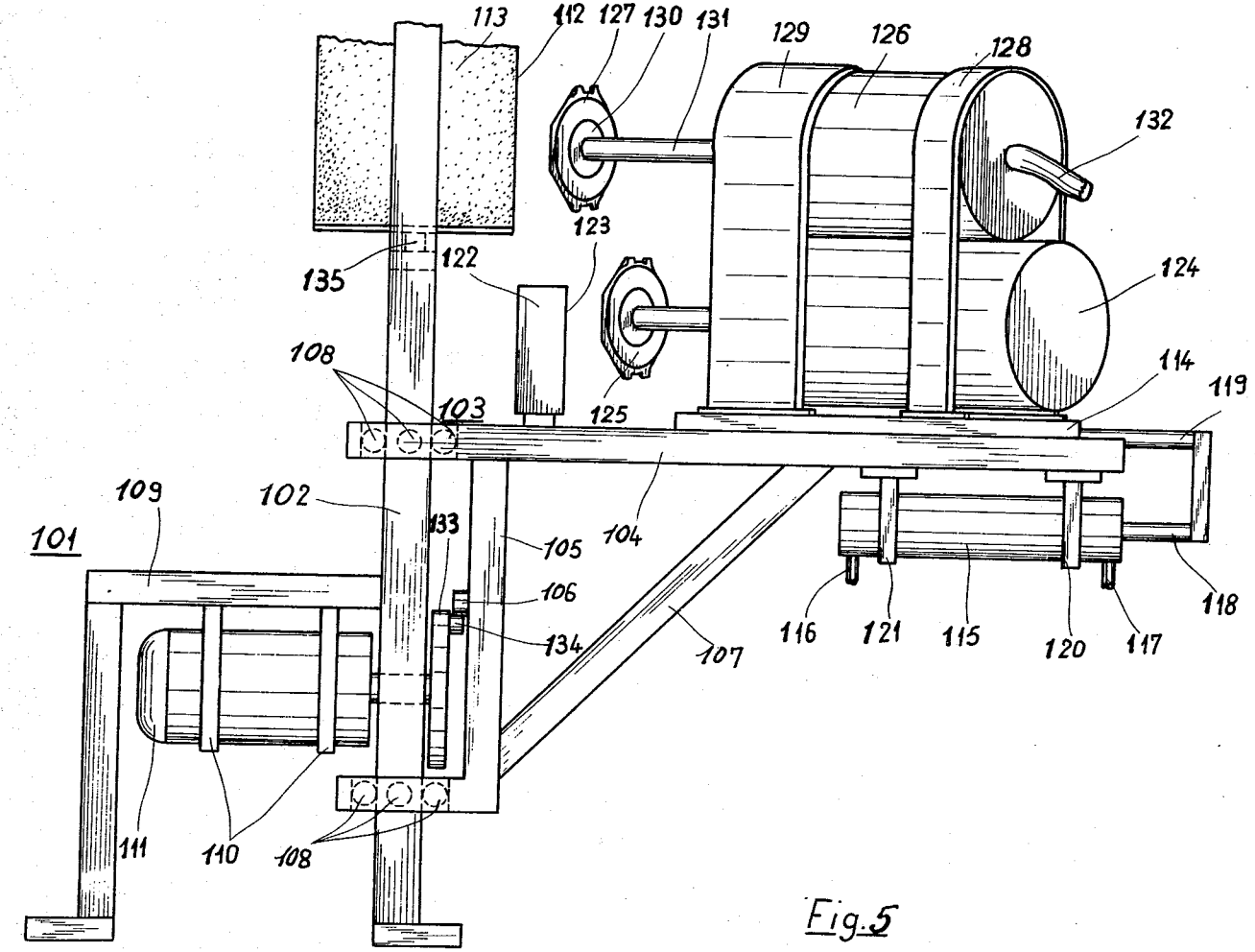
Figure 6:
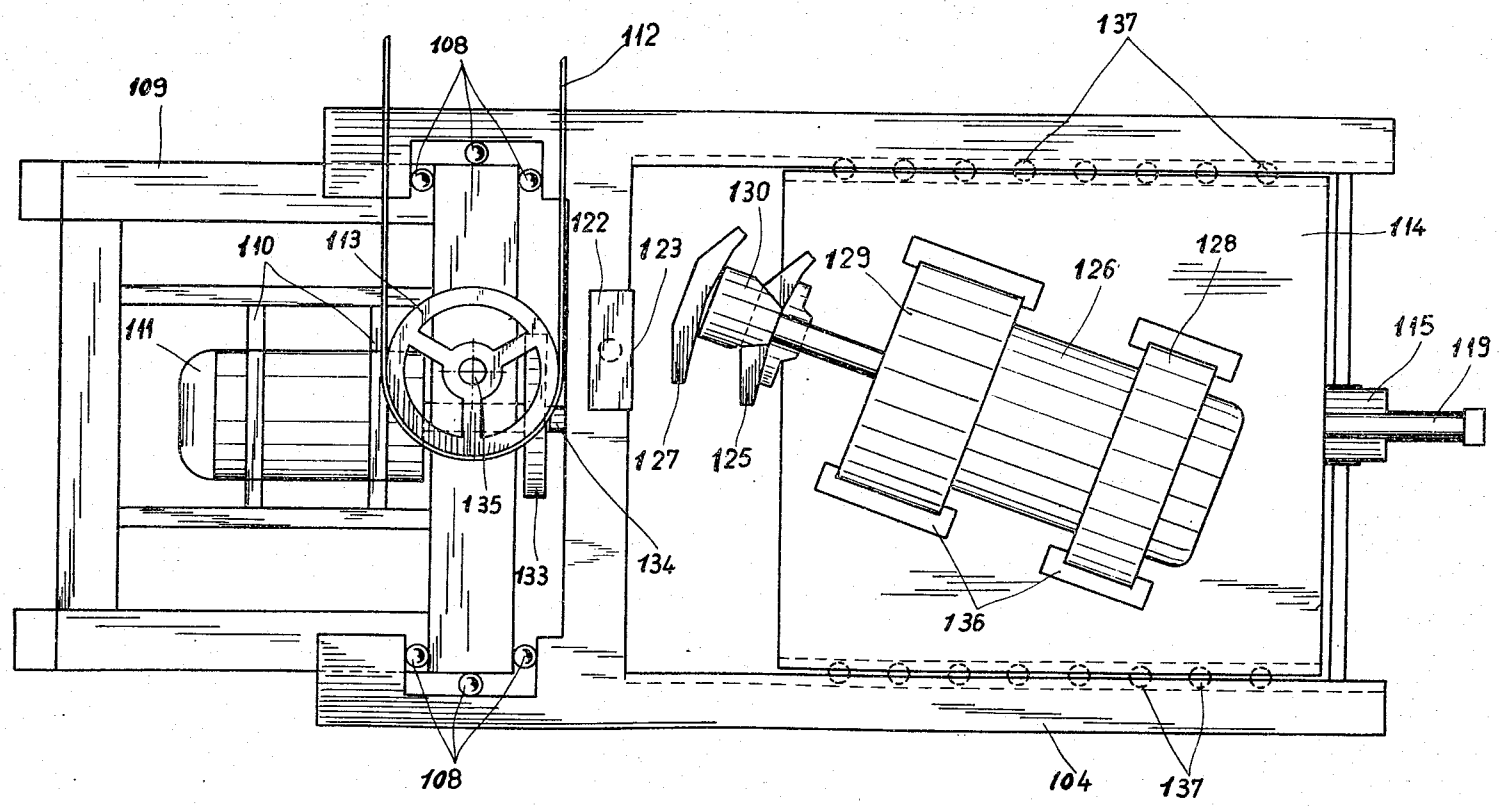
Figure 7:
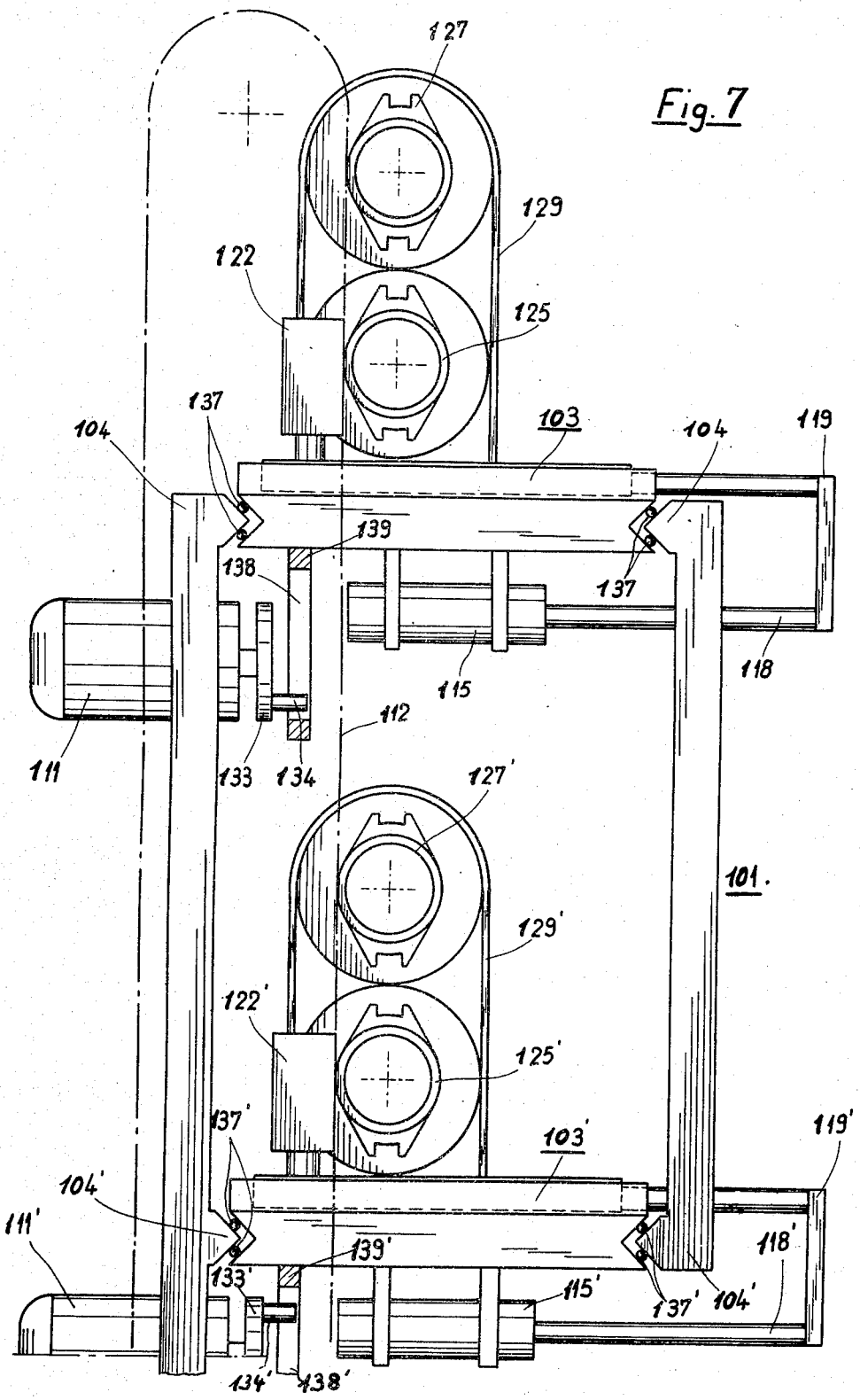
Figure 8:
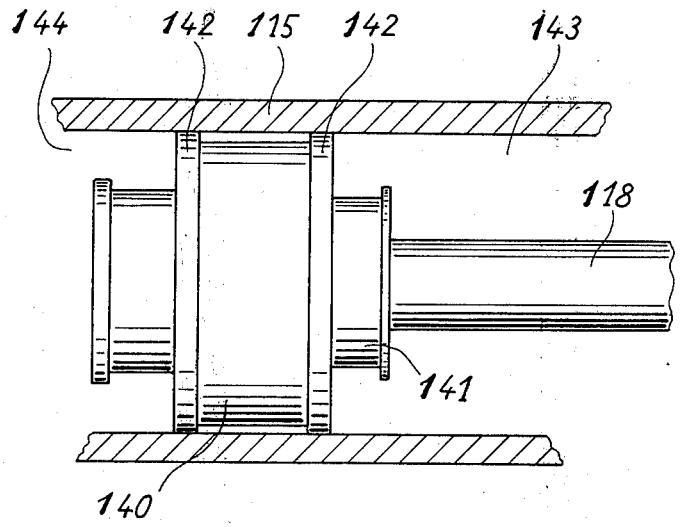
Figure 9:
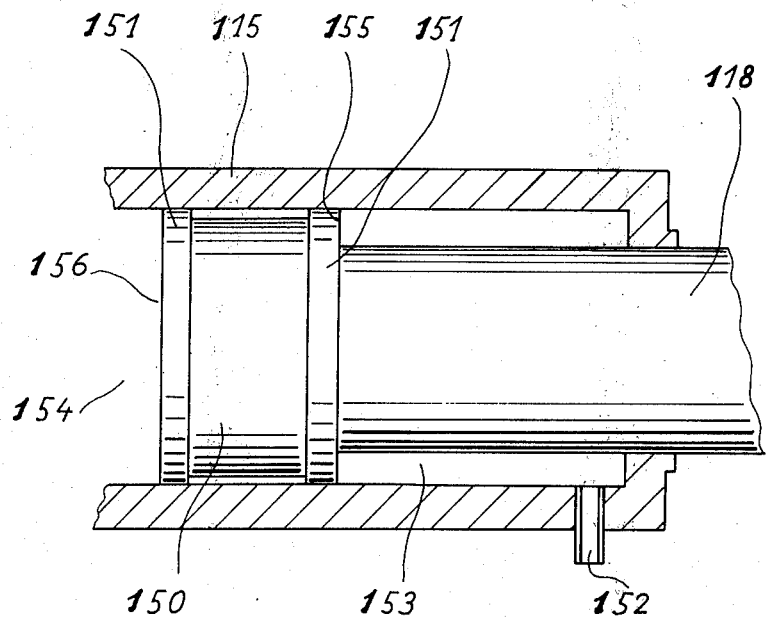
Figure 10:
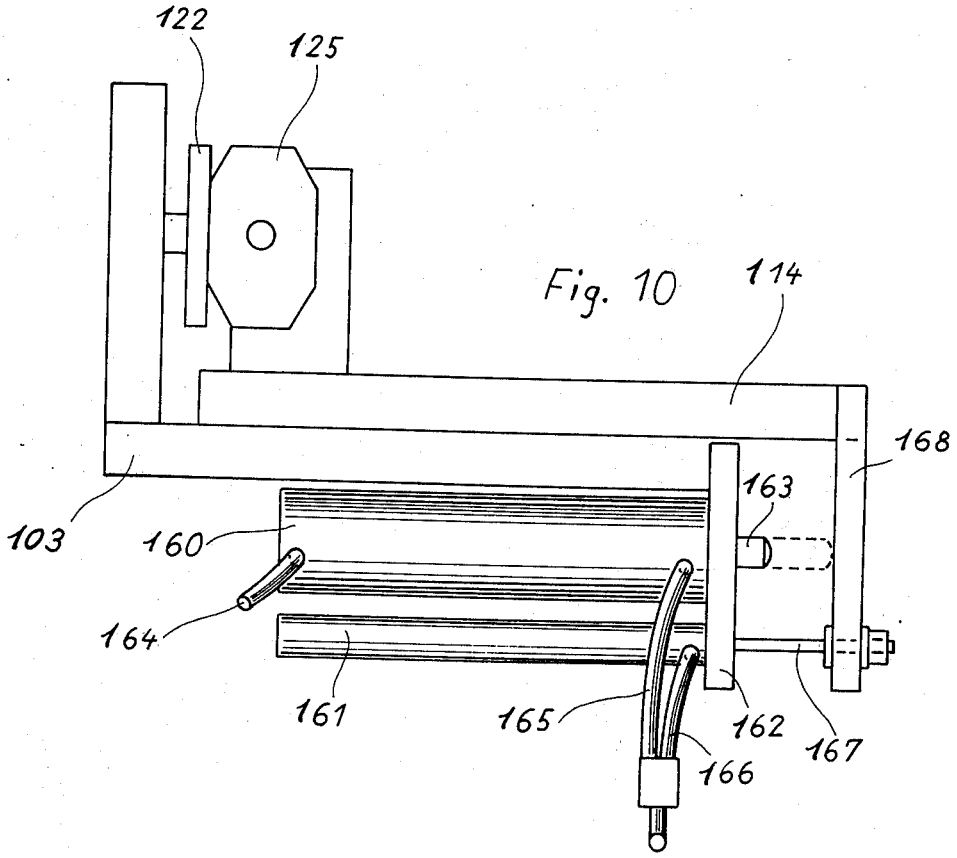
Figure 11:
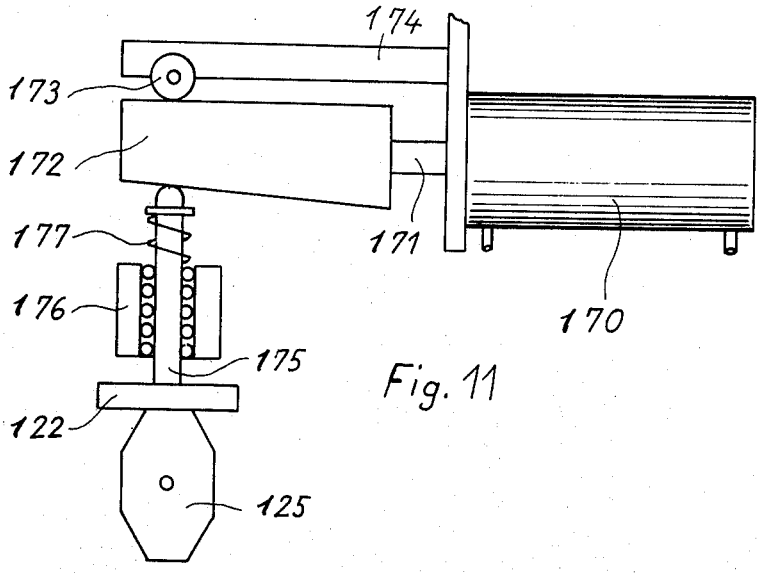

To facilitate the positioning of the part to be machined on its drive shaft, a pneumatic chuck is envisaged which guarantees the stability of its position in the course of the grinding cycle, and which is operating by the pressured fluid which also controls the movement of the piston coupled to the mobile carriage. The present invention will be better understood by referring to the description of the examples of construction and drawings attached hereto in which:

FIG. 1 is a diagram of a form of construction of a grinding machine in accordance with the invention, FIG. 2 is an enlarged drawing of the device controlling the pressure with which the part to be ground is applied to the grinding surface and after control device for the movement of the mobile carriage, FIG. 3 is an alternative construction of the device of FIG. 2, FIG. 4 is a perspective view illustrating partially the drive coupling of the part to be ground and the reciprocating mechanism of the machine of FIG. 1, FIG. 5 is a perspective view of another form of construction of the grinding machine in accordance with the invention, in which the part to be machined is submitted to an alternative vertical movement, FIG. 6 is a plan view of the grinding machine of FIG. 5, illustrating the relative positions of the cam, the part to be machined, the stop of the cam and the grinding surface, FIG. 7 is a front elevational view of the preferred kind of construction of the grinding machine in accordance with the invention, comprising two tables with alternative horizontal movement, along one same vertical abrasive band, FIG. 8 represents a partial section of the cylinder illustrating another form of construction of the piston, FIG. 9 is a view of a partial section of the cylinder representing another form of construction of the piston, FIG. 10 represents schematically another possibility of the device which controls the movement of the mobile carriage, FIG. 11 represents schematically the device intended to set the depth of the machining passes.

With reference to FIG. 1, the mobile carriage 1, is mounted on two horizontal rails preferably, on which it can move to and fro under the action of the pneumatic or hydraulic control device 3. The carriage carries a conventional drive motor 4 fixed by means of two straps 5 and bolts 6. The rotor (not represented) is mounted on a shaft 7, the free extremity of which carries a head 8 on which is fitted a cam 9. The head 8 and the cam 9 can be made of one solid piece at the extremity of the shaft or in two pieces easily demountable.

Carriage 1 carries furthermore a second shaft 11 similar to shaft 7, of which one of the extremities is equipped with a head 12 adapted to receive a part 13 to be ground. This shaft is supported by two bearings 14 maintained between four vertical columns 15 fixed rigidly to carriage 1. The bearings 14 can slide vertically between columns 15 due to the diagrammatic arrangement represented by balls 16.

The vertical movement of shaft 11 is controlled by an excentric 18 fixed for example between the two bearings 14 and resting constantly on an idle wheel 19.

The simultaneous driving of the two shafts 7 and 11 is realised by mechanical coupling of a notched belt 20 passing over pinions 21 and 22 and roller 23 of tightener 24. The tightener 24 is diagramatically represented by a U-shaped part 25 carrying the axis of roller 23 urged in a tightening direction by a spring 26.

The control device 3 for moving carriage 1 comprises a cylinder 27 and a piston the piston rod 28 of which is connected by a strap 29 to the mobile carriage. Two entry conduits A and B permit a source of pressurised fluid to commucicate with the interior of cylinder 27.

FIG. 1 represents the mahcine in working position, cam 9 resting against a fixed stop 10 and the part to be ground 13 resting against the grinding surface 17.

With reference to FIG. 2, the control device (here indicated by reference numeral 30) for the movement of the mobile carriage 1 comprises essentially a cylinder 31 having an interior cavity 32 divided into two chambers 33 and 34 by a piston 35. Piston 35 is composed of a cylindrical hollow sleeve 36 through which piston rod 37 extends. This rod 37 projects beyond the ends 39 and 45 of the cylinder by sliding in two bores 38 and 50.

Sleeve 36 is surrounded by an annular bloc 40 which constitutes the body of piston 35. The lateral cylindrical surface of body 40 of piston 35 carries two piston or sealing rings 41 of rectangular section which rub against the lateral surface of the interior cavity 32 of cylinder 31. Sleeve 36 has at one end an annular flange 42 which engages body 40 of piston 35 as well as a helical spring 46 the other extremity of which rests against a stop 47 being an integral part of piston rod 37.

Chamber 33 communicates with an admission pipe 48 corresponding to entry A of FIG. 1; chamber 34 communicates with an admission pipe 49, identical to admission pipe 48, corresponding to entry B of FIG. 1. A nut 53 is screwed onto rod 37 which rests against one of the flat faces of body 40 of piston 35.

With reference to FIG. 3, a cylinder 31′ having an interior cavity 32′ contains a piston 35′. The piston is composed of a cylindrical hollow sleeve 36′ through which piston rod 37′ extends. The body 40′ of piston 35′ is crossed in a plate 55 extending transversely thereof and in the center of which is fixed a plug 56. The rod 37′ is at least partially hollowed and contains a helical spring 46′, one extremity of which rests against plug 56. The other extremity of spring 46′ rests against plug 57 screwed into a thread 58 inside one of the extremities of rod 37′. The plug 57 has a double purpose serving as a stop for spring 46′ and to permitting the regulation of the tension of said spring.

A plug 59 integral with piston rod 37′ serves as a stop for body 40′ of piston 35′.

The other elements such as piston sealing rings 41′ and the admission pipes 48′ and 49′ are the same as the corresponding elements of FIG. 2.

Initially, carriage 1 is in the position of stand still, that is cam 9 and part 13 are at their maximum distance from stop 10 and grinding surface 17, respectively. The piston 35, 35' is positioned against the end wall 54, 54' of cylinder 31, 31' and spring 46, 46' is completely relaxed.

When a switch valve (not shown) is actuated to connect admission pipe 49, 49' to a source of pressurised fluid, chamber 34 fills progressively with this fluid and exerts a pushing motion onto the piston making it move to the left (with reference to FIGS. 2 and 3). The spring 46, 46' compresses slightly and finishes by draging the rod 37, 37' by exercising a pushing motion onto stop 47 or onto plug 57. The movement of the piston will stop when it arrives touching against wall 51, 51' of cylinder 31, 31'. At this moment, the rod 37, 37' of the piston will have brought along carriage 1, 1' into the operating position, that is that cam 9 and part 13 are in position against stop 10 and the grinding surface 17 with a force predetermined by the choice of the spring and/or the setting in position of plug 57 and stop 47, serving as rest for the spring.

During the operation of the machine the duration of which is determined by a timer (not shown), the pressurised fluid maintains the piston against end wall 31, as shown in FIG. 3. The pressure of spring 46, 46' pushes the carriage in such a way that cam 9 constantly rests against stop 10. The weak axial movements due to the permanent contact of the cam with the corresponding stop transmit themselves to the carriage and simultaneously to the part to be ground and to rod 37, 37' of the piston. These provoque a slight contraction of spring 46, 46' and a free sliding of rod 37, 37' in the sleeve 36, 36' which stays in place against body 40, 40' of piston 35, 35'.

During this entire phase the part is driven in rotation by the driving device of the cam and subjected to the excentric 18 described above. At the end of the operation the valve switch (not shown) is actuated to feed pressurised fluid to chamber 33. This fluid exercises a pushing motion onto piston 35, 35' which pushes rod 37, 37' towards the right (with reference to FIGS. 2 and 3) to bring back the carriage into its initial standstill position.

At the end of this working cycle, a new part is fixed on the head 12 and a new grinding cycle can commence.

It is certain that a single carriage can be equipped with several shafts carrying each a part to be ground or that a single hydraulic or pneumatic control device can control several mobile carriages.

With reference to FIG. 4, the reciprocating movement mechanism comprises a wheel 18 fitted excentrically on shaft 11 and a wheel 19 centered on axis 60 situated in the same vertical plan as shaft 19. The driven pinion 22 is driven by the notched belt 20 which is tightened downwards by a spring 26 acting on a roller 23. The spring 26 has a pulling action, fixed on the one side on a U shape part 25 and onto carriage 1 by a fixed part 61.

With reference to FIG. 5, the rigid frame 101 comprises essentially two vertical columns 102, serving as guides to the mobile table 103 composed of two horizontal rails 104, a vertical frame 105 comprising a cross piece 106, the function of which will be described below, and a reinforcement 107 connecting the rails 104 to the frame 105 and insuring the rigidity of the mobile table assembly 103. Bearings schematically indicated by means of balls 108 permit the free sliding of table 103 along columns 102. The frame 101 is completed by a support 109 on which is mounted the cradle 110 of the drive motor 111 responsible for the reciprocating movement of table 103. The upper part of the frame carries the belt-like grinding surface 112 carried on two cylinders 113 with vertical shaft 135.

On table 103 is mounted a mobile carriage 114 which can move horizontally under the action of the piston contained inside cylinder 115 and is subjected to the action of a pressurised fluid which can be injected into the ends 116 and 117. The rod of piston 118 is rigidly connected to carriage 114 by an appropriate system of rods 119. The cylinder 115 is fixed to the lateral rails 104 of the mobile table by supports 120 and 121.

On the table is mounted a rigid stop 122 having a flat surface 123 parallel to the grinding surface 112.

On the mobile carriage 114 are mounted a drive motor 124 of cam 125 and a driving device 126 for the part to be machined 127, both being connected by a strap of fixation 128 and a mechanical coupling protected by a casing 129.

The part to be machined is fixed onto a hollow shaft 131 by a chuck 130, pneumatic or hydraulic, the pressurised fluid being introduced by conduit 132 connected to a source of fluid under pression not shown.

When the part to be machined has been fixed onto chuck 130, the pressurised fluid is injected through the conduit 117; the piston moves from right to left (on FIG. 5) and moves carriage 114 until cam 125 enters into contact with surface 123 of stop 122. Simultaneously the part to be ground enters into contact with the abrasive surface 112.

The motor 111 carries at the shaft end a pulley 133 on which is mounted an excentric pin 134 disposed in such a manner that the cross piece 106 and consequently the whole of the mobile table 103 rests on it under the action of its own weight. When the motor 111 is switched on, the excentric pin 134 turns imparting to the table a reciprocating vertical movement so that the part to be ground 127 moves vertically, for example through a distance corresponding to the lower half of the abrasive band 112. During the whole grinding operation the motor 124 drives in rotation the cam 125 and the part to be ground 127.

FIG. 6 which is a top view of the grinding machine shown in FIG. 5 illustrates the relative positions of the cam 125 and the stop 122 on the one hand, and of the part to be ground 127 and the grinding surface 112 on the other hand. The drive motor 124 of the cam and the driving device 126 of the part to be ground are connected by strap 128 and the casing 129, themselves fixed to carriage 114 by attachment means 136. The carriage 114 can slide along the rails 104 due to a ball bearing schematically indicated by balls 137 represented by dotted lines.

FIG. 7 is a front view of a grinding machine in accordance with the invention comprising two tables 103 and 103' moving alternatively on a horizontal plane along the grinding surface 112 of an abrasive band which is arranged vertically. The rigid frame 101 supports the two tables 103 and 103' which can slide horizontally along the lateral rails 104 and 104' by means of schematically indicated bearings by balls 137 and 137' in such a manner that both parts to be ground 127 and 127' are machined, during the operating phase where they occupy the position illustrated by FIG. 7, respectively by the front half and the back half of the abrasive band. The function of the drive cams 125 and 125' is similar to what has been described previously.

The alternative movement of the tables 103 and 103' is realised by means of two motors 111 and 111' which, like the motor 111 of FIGS. 5 and 6 carry each at the drive shaft end a pulley 133 (respectively 133'). An excentric pin 134 (respectively 134') engages into a vertical slit 138 (respectively 138') of a part 139 (respectively 139') forming one part with table 103 (respectively 103'). The rotation of the excentrics 134 and 134' produces a horizontal reciprocating movement of the tables 103 and 103'.

With reference to FIG. 8, the cylinder 115 contains a first piston 140 of cylindrical shape, through which can slide a second piston 141 coaxially in realtion to the first. The rod 118 connects the interior piston 141 to the mobile table 103. The piston 140 is surrounded at its extremities by two annular sealing rings 142 which insure the tightness between the two chambers 143 and 144 of cylinnder 115.

When the pressurised fluid is brought to the chamber 144 by a conduit (not shown), it exercises a pushing motion onto the surface of piston 140 which moves from left to right (on FIG. 8) driving the interior piston 141 itself connected to the mobile table 103, in such a manner that the part to be mahcined will be removed from the abrasive surface.

When a pressurised fluid is brought to chamber 143, the pushing motion exercised onto the surfaces of pistons 140 and 141, drives the mobile table by the intermediary of rod 118 until cam 125 rests against stop 122.

The relation of the surfaces of the flat faces of the pistons 140 and 141 is chosen in such a manner that the pushing motion exercised by the pressure which can be controlled reigns at the interior of chamber 143, on the face of piston 141 be inferior to that exercised onto the face of piston 140. In this manner the interior piston 141 can slide inside piston 140 and permits the small movements of the part to be machined in accordance with those of the cam, all the time pressing the part with a predetermined pressure against the abrasive surface.

With reference to FIG. 9, the cylinder 115 contains a piston 150 connected to a piston rod 118 of relatively large diameter in relation to the diameter of piston 150.

As previously, the piston is surrounded by two sealing rings 151, which insure the tightness between chambers 153 and 154 of cylinder 115.

When a pressurized fluid is introduced into chamber 154, it exercises a pushing motion on the face of piston 150 which moves from left to right (FIG. 9).

When a pressurized fluid is injected into the interior of chamber 153 by means of a conduit 152, it exercises a pushing motion onto the annular surface 155 of one of the flat faces of piston 150. The relation of the annular surface 155 to the circular surface 156 is determined in such a manner that an efficacious breaking action opposes the movement of the piston wheen a pressurized fluid is injected into chamber 153, and on the other hand, the pushing motion exercised onto the annular surface 155 is sufficiently weak to permit the small movements of the cam and the part to be ground, maintaining all the time the latter in contact with the abrasive surface under a predetermined pressure which can be regulated in accordance with the parts to be machined.

With reference to FIG. 10, two cylinders 160 and 161 are mounted on a plate 162 which forms an integral part of the mobile table 103. The cylinder 160 of large diameter contains a piston (not shown) with a double effect connected to a piston rod 163. It is also equipped with two pressurized fluid feeding tubes 164 and 165. The cylinder 161, of small diameter and comprising one only pressurized fluid feed 166, contains a piston (not shown) of which the rod 167 is fixed to plate 168, itself connected to the mobile carriage 114.

When injecting the pressurized fluid into the tube 164 the rod 163 of the piston contained in cylinder 160 pushes the plate 168 towards the right (on FIG. 10) so that the cam 125 travels away from stop 122. When a pressurized fluid is injected simultaneously into leads 165 and 166, the piston rods 163 and 167 move simultaneously towards the left (on FIG. 10). The piston rod 163, the extremity of which is free, reaches a position in which it no longer in contact with plate 168. On the other hand rod 167, fixed to plate 168, drives the latter as well as the mobile carriage 114 and brings cam 125 in contact with stop 122. The pressure which is exercised onto the piston contained in the cylinder of small diameter 161, can be regulated to a value sufficiently feeble to permit the small movements of cam 125 in relation to stop 122.

The function of the piston contained in the cylinder of large diameter 160 is double. On the one hand it makes it possible to remove cam 125 from stop 122; on the other hand it makes it possible to break the movement of the mobile carriage when cam 125 approaches stop 122.

With reference to FIG. 11, the device permitting to set the depth of the machine passes comprises a piston which double effect contained in a cylinder 170, the piston rod of which 171 carries a V shaped cam 172. Under the action of a pressurized fluid acting onto the piston in the interior of cylinder 170, the V shaped cam 172 can move towards the left or towards the right (on FIG. 11) by rolling on a supporting cylinder 173 fixed on support 174. Stop 122 is carried by a shaft 175 which is able to move upwards and downwards (on FIG. 11) inside a support with bearings 176 and under the action of cam 172 or of a coil spring 177.

Stop 122 is initially brought into a first position in which it is maintained until the movement when cam 125 comes to rest against it. In this position, the part to be machined is in contact with the abrasive surface. By the intermediary of the V shaped cam, the stop 122 returns into the second position, the space between the first and second position corresponds to the depth of the machining passes.

The machine according to the invention makes it possible to grind in a rapid and regular manner and with great precision small mechanical parts. It saves considerable time in the course of their manufacture and produces a large number of identical parts without any noticeable difference between them. Consequently it is possible to gurarantee a very constant quality of the parts produced at a small cost price.

I claim:

1. A machine for grinding small mechanical parts comprising a rigid frame, a rotatable flat grinding surface mounted on said frame, a cam rest carried by said frame and having a flat surface parallel with the flat grinding surface, a carriage mounted on said frame for reciprocal movement in a direction perpendicular to said flat grinding surface, a rotary guide cam carried by said carriage, a workpiece support mounted for rotation about an axis parallel to the axis of rotation of the guide cam, means for rotating said guide cam and said workpiece support in synchronism, and a drive device mounted on said frame for moving the carriage towards and away from the flat grinding surface, said drive device comprising a first control device for moving said carriage and a second control device for regulating the pressure with which the workpiece is applied to the flat grinding surface, said second control device being included in the first control device.

2. A machine according to claim 1 in which the carriage device comprises a cylinder, a piston reciprocably mounted in the cylinder, a piston rod carried by the piston and connected to the carriage for reciprocating the same and means connected to each end of the cylinder for supplying fluid under pressure thereto for moving the piston.

3. A machine according to claim 2, in which the device controlling the pressure applied to the workpiece to be ground comprises a helical spring concentric with the piston rod, one end of which engages the piston and the other end of which engages a stop carried by the piston rod.

4. A machine according to claim 3, in which the piston rod is cylindrical and hollow and the helical spring is mounted therein.

5. A machine according to claim 2, in which the piston is provided with a central axial opening and a secondary piston is mounted in the central cylindrical opening provided in the first-mentioned piston.

6. A machine according to claim 2, in which the piston rod has a diameter relatively large, as a result of which the pressure exerted by a fluid on the face of the piston will be considerably greater than that exerted by the pressurized fluid on the annular surface of the piston from which the piston rod extends.

7. A machine according to claim 2, in which two pistons are provided of which one, of large diameter and with double effect, is to effect the movement of the carriage in a first direction and its braking in the opposite direction, and the other of small diameter and small effect, to insure movement of the carriage in said opposite direction.

8. A machine according to claim 1, in which the carriage is also mounted for vertical reciprocating movement and a motor having a shaft carrying at its free end an eccentric on which rests the entire weight of the carriage.

9. A machine according to claim 1, in which said cam rest is adjustable by means of a V-shaped cam between first and second positions so that the distance which separates the two positions corresponds to the depth of the machining passages.

* * * * *